US009527686B2

(12) United States Patent
Wang et al.

(10) Patent No.: US 9,527,686 B2
(45) Date of Patent: Dec. 27, 2016

(54) SHEET CONVEYING DEVICE

(71) Applicant: BROTHER KOGYO KABUSHIKI KAISHA, Nagoya-shi, Aichi-ken (JP)

(72) Inventors: Huanfa Wang, Nagoya (JP); Daisuke Kozaki, Nagoya (JP); Takashi Ohama, Iwakura (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/668,404

(22) Filed: Mar. 25, 2015

(65) Prior Publication Data

US 2015/0274448 A1 Oct. 1, 2015

(30) Foreign Application Priority Data

Mar. 31, 2014 (JP) ..... 2014-072511

(51) Int. Cl.
*B65H 3/06* (2006.01)
*B65H 31/02* (2006.01)
(Continued)

(52) U.S. Cl.
CPC ..... *B65H 3/0684* (2013.01); *B65H 1/04* (2013.01); *B65H 5/062* (2013.01); *B65H 31/02* (2013.01); *B65H 83/02* (2013.01); *B65H 2402/441* (2013.01); *B65H 2403/945* (2013.01); *B65H 2404/6111* (2013.01); *B65H 2405/111* (2013.01); *B65H 2405/115* (2013.01); *B65H 2405/324* (2013.01); *B65H 2405/3322* (2013.01); *B65H 2407/50* (2013.01);
(Continued)

(58) Field of Classification Search
CPC ..... B65H 31/02; B65H 3/0684; B65H 83/02; B65H 1/04; B65H 5/062; B65H 2407/50; B65H 2405/111; B65H 2405/115; B65H 2405/324; B65H 2405/3322; B65H 2402/441
See application file for complete search history.

(56) References Cited

U.S. PATENT DOCUMENTS

2002/0056957 A1 5/2002 Sekine
2010/0252987 A1* 10/2010 Furuyama ..... B65H 1/04 271/3.14

(Continued)

FOREIGN PATENT DOCUMENTS

JP 4447764 B2 4/2010
JP 2012126530 A 7/2012
JP 5321818 B2 10/2013

*Primary Examiner* — Patrick Cicchino
(74) *Attorney, Agent, or Firm* — Merchant & Gould P.C.

(57) ABSTRACT

A sheet conveying device includes: a supporter which support a sheet to be supplied or a discharged sheet. The supporter includes: a first cover pivotable between a closed position and an open position and capable of supporting the sheet when the first cover is located at the open position; and a second cover pivotable between a first position and a second position and constituting a portion of an exterior of the sheet conveying device with the first cover when the second cover is located at the first position. The second cover has a first end portion contactable with the first cover located at the closed position. The first end portion is kept in contact with the first cover throughout a period in which the second cover is pivoted from the first position to the second position.

16 Claims, 10 Drawing Sheets

(51) Int. Cl.

| | |
|---|---|
| ***B65H 81/02*** | (2006.01) |
| ***B65H 1/04*** | (2006.01) |
| ***B65H 5/06*** | (2006.01) |
| ***B65H 83/02*** | (2006.01) |

(52) U.S. Cl.
CPC ..... *B65H 2511/12* (2013.01); *B65H 2511/22* (2013.01); *B65H 2601/261* (2013.01); *B65H 2601/522* (2013.01); *B65H 2801/39* (2013.01)

(56) References Cited

U.S. PATENT DOCUMENTS

2012/0155941 A1* 6/2012 Kozaki ..... H04N 1/00525
399/367
2012/0256370 A1* 10/2012 Kozaki ..... H04N 1/0053
271/264
2012/0261880 A1* 10/2012 Kozaki ..... B65H 1/04
271/264
2013/0164064 A1* 6/2013 Matsumoto ..... B65H 1/04
399/361
2013/0170001 A1* 7/2013 Takahata ..... H04N 1/00588
358/498
2013/0195533 A1* 8/2013 Yamamoto ..... G03G 15/6552
399/405
2013/0259553 A1* 10/2013 Sugiyama ..... G03G 15/6529
399/381
2015/0091240 A1* 4/2015 Miura ..... B65H 1/04
271/3.18

* cited by examiner

SHEET CONVEYING DEVICE

CROSS REFERENCE TO RELATED APPLICATION

The present application claims priority from Japanese Patent Application No. 2014-072511, which was filed on Mar. 31, 2014, the disclosure of which is herein incorporated by reference in its entirety.

BACKGROUND

Technical Field

The following disclosure relates to a sheet conveying device.

Description of the Related Art

There is known an image reading device provided with an automatic document feeder (ADF) and having a construction in which when an upper cover is opened, the cover serves as both of a supply tray and a discharge tray.

For example, an upper surface of an image reading device is constituted by three covers arranged in a right and left direction (noted that these covers may be hereinafter referred to as "left cover", "central cover", and "right cover"). The central cover is pivotable about an axis extending in a front and rear direction near a left end of the central cover. When the central cover is closed, a document supply opening and a document output opening are covered with the central cover, so that the left cover, the central cover, and the right cover constitute a flat exterior surface as the upper surface of the image reading device. When the central cover is opened, a document can be supported on a support surface of the central cover which is a back side of the central cover from the exterior surface, that is, the central cover serves as both of a supply tray and a discharge tray.

SUMMARY

In the above-described image reading device, incidentally, when the closed central cover is opened, a right end of the central cover is moved downward to a position lower than a left end of the right cover, so that a space formed between the central cover and the right cover is widened. If the space is thus widened, a foreign matter may unfortunately fall from the space into the image reading device. If a foreign matter has entered in the image reading device, the foreign matter may cause an unexpected trouble.

Accordingly, an aspect of the disclosure relates to a sheet conveying device capable of suppressing ingress of a foreign matter into the sheet conveying device from an area between two covers which are adjacent to each other and one of which can be opened and closed.

In one aspect of the disclosure, a sheet conveying device includes: a conveyor configured to convey a sheet along a conveyance path; and a supporter configured to support one of a sheet to be supplied to the conveyor and a sheet to be discharged from the conveyor. The supporter includes: a first cover pivotable between a closed position and an open position about a first axis, the first cover constituting a portion of an exterior of the sheet conveying device in a state in which a first exterior surface of the first cover faces toward an outside of the sheet conveying device when the first cover is located at the closed position, the first cover supporting the sheet when the first cover is located at the open position; and a second cover pivotable between a first position and a second position about a second axis extending parallel with the first axis, the second cover constituting a portion of the exterior of the sheet conveying device with the first cover when the second cover is located at the first position. The first cover has an end portion adjacent to the second cover in a state in which the first cover is located at the closed position. The end portion is formed with a recessed portion recessed from the first exterior surface toward an inside of the sheet conveying device in the state in which the first cover is located at the closed position. The second cover has an end portion adjacent to the first cover in a state in which the second cover is located at the first position. The end portion of the second cover is provided with a first end portion, at least a portion of which is to be inserted into the recessed portion of the first cover located at the closed position and is contactable with the first cover. The first end portion is kept in contact with the first cover throughout a period in which the second cover is pivoted from the first position to the second position.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described a sheet conveying device according to one embodiment.

Configuration of MFP

Figure 1:
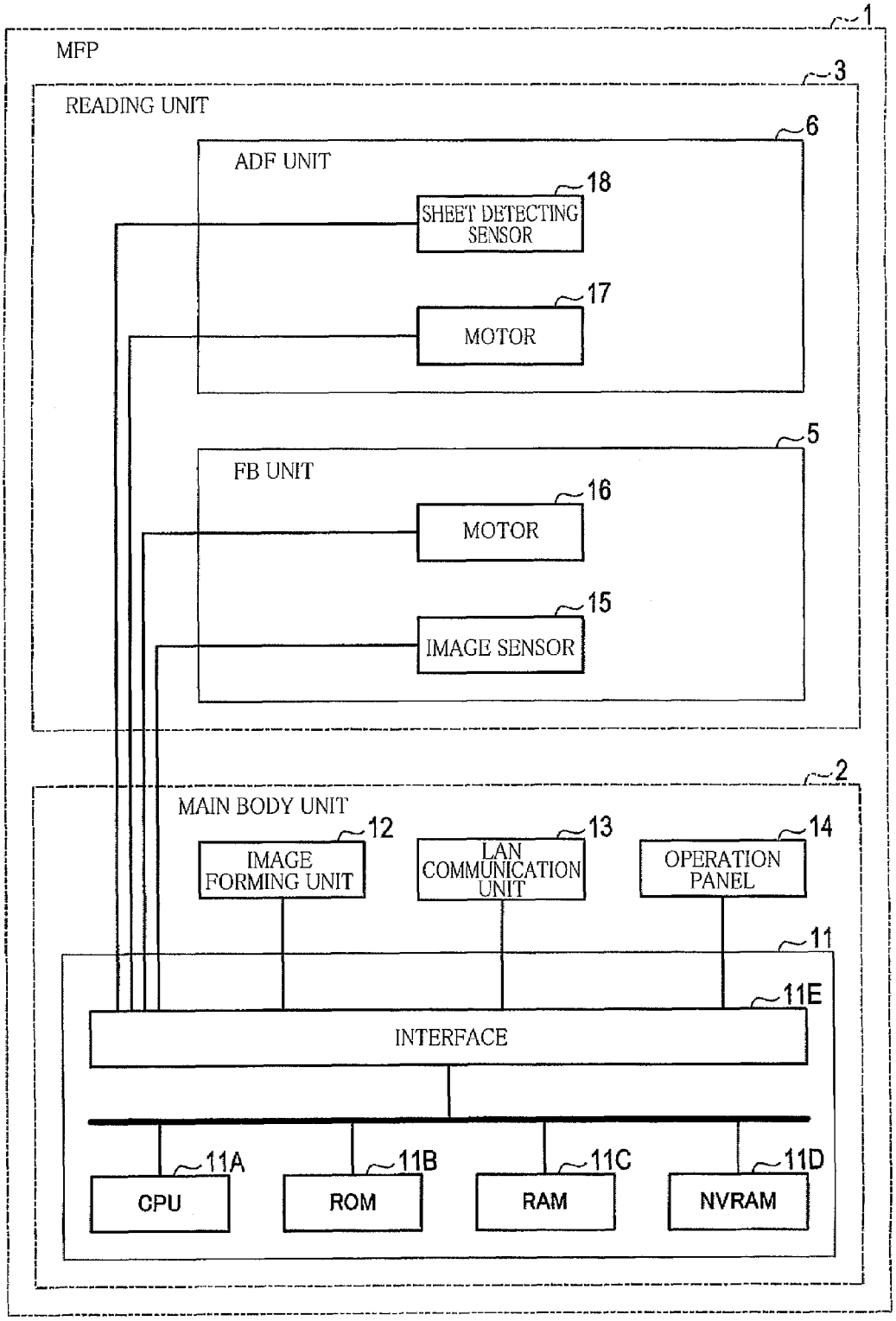
FIG. 1 is a block diagram illustrating a configuration of a multi-function peripheral (MFP)

A multi-function peripheral (MFP) 1 illustrated in FIG. 1 has a configuration corresponding to one example of the sheet conveying device. For easy understanding of a relative positional relationship of components of the MFP 1, in the following explanation, there will be expressed (a) an upward and downward direction which is a direction perpendicular to a horizontal plane in the case where the MFP 1 is placed on the horizontal plane, (b) a front direction in which an operation panel 14 which will be described below faces, (c) a rear direction which is opposite the front direction, and (d) a right and left direction which is a right and left direction in the case where the MFP 1 is viewed from a front side thereof. A direction of a movable component may be changed, and the directions illustrated in figures (FIGS. 2-8) are not always kept.

As illustrated in FIG. 1, the MFP 1 includes a main body unit 2 and a reading unit 3. An upper face of the main body unit 2 has an opening, not shown. The reading unit 3 is mounted in an upper portion of the main body unit 2 and movable between a closed position and an open position. When the reading unit 3 is located at the closed position, the opening of the main body unit 2 is closed by the reading unit 3. When the reading unit 3 is located at the open position, the opening of the main body unit 2 is open or exposed. Through this opening, a user can perform maintenance of components provided in the main body unit 2. The reading unit 3 includes an FB (flat bed) unit 5 and an ADF unit 6 as one example of a sheet conveying device. Constructions of the FB unit 5 and the ADF unit 6 will be described below.

As illustrated in FIG. 1, the main body unit 2 includes a controller 11. The controller 11 includes well-known devices such as a CPU 11A, a ROM 11B, a RAM 11C, an NVRAM 11D, and an interface 11E. The CPU 11A controls the components and devices of the MFP 1 by executing processings according to control programs stored in the ROM 11B and the RAM 11C.

The components and devices controlled by the controller 11 include an image forming unit 12, a LAN communication unit 13, the operation panel 14, an image sensor 15, a motor 16, a motor 17, and a sheet detecting sensor 18. The image forming unit 12, the LAN communication unit 13, and the operation panel 14 are provided in the main body unit 2. The image sensor 15 and the motor 16 are provided in the FB unit 5. The motor 17 and the sheet detecting sensor 18 are provided in the ADF unit 6.

The image forming unit 12 is an ink-jet image forming unit capable of forming an image on a recording medium such as a cut sheet. Specifically, the image forming unit 12 includes: a conveying mechanism for conveying the recording medium; a recording head for ejecting ink; and a drive mechanism for reciprocating the recording head. These devices are well known, and an explanation and illustration of which are dispensed with. It is noted that the image forming unit 12 may be an electronic-photographic image forming unit.

The LAN communication unit 13 includes a communication interface device for wireless LAN and a communication interface device for wired LAN. The operation panel 14 includes input devices and output devices. The input devices are operated by the user for providing various instructions to the MFP 1. Examples of the input devices include a touch panel and various kinds of buttons and switches. The output devices are for notifying the user about an operating state of the MFP 1. Examples of the output devices include a liquid crystal display and various kinds of lamps.

The image sensor 15 is a one-dimensional image sensor including a plurality of reading elements arranged in one direction. In the present embodiment, the image sensor 15 is a contact image sensor (CIS). The motor 16 is a power source for moving the image sensor 15 in a sub-scanning direction which is perpendicular to a main scanning direction coinciding with the direction in which the reading elements of the image sensor 15 are arranged. The motor 17 is a power source for conveying the sheet by the ADF unit 6. The sheet detecting sensor 18 detects that a leading edge or a trailing edge of the sheet conveyed by the ADF unit 6 in a sheet conveying direction has passed through a predetermined detecting position.

In the present embodiment, the sheet detecting sensor 18 is a contact sensor whose ON state and OFF state are switched depending on whether the sheet being conveyed is contacting the sensor or not. However, another type of sensor may be used as the sheet detecting sensor 18. For example, the sheet detecting sensor 18 may be a non-contact sensor capable of detecting that the leading edge or the trailing edge of the sheet in the sheet conveying direction has passed through the predetermined detecting position. Examples of such a non-contact sensor include: an optical sensor capable of detecting whether the sheet being conveyed is intercepting a light path or not; and an optical sensor capable of detecting whether light is reflected from the sheet being conveyed or not.

Details of Reading Unit

Figure 2A:
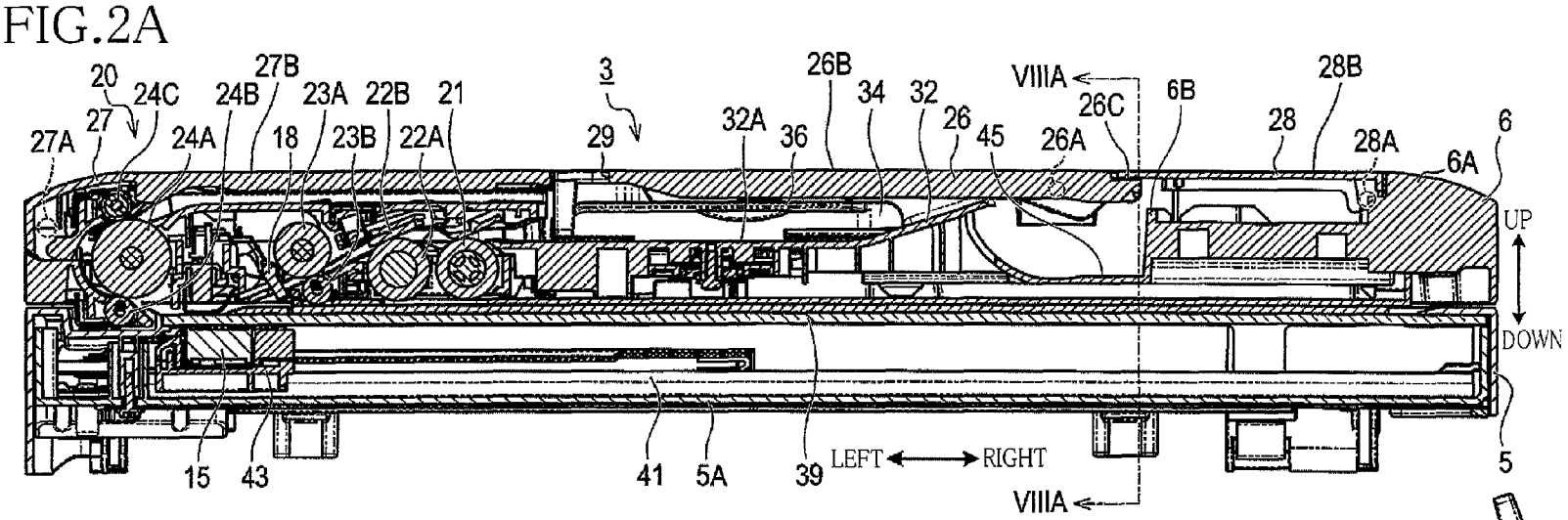
FIG. 2A is an elevational view in vertical cross section illustrating a reading unit whose central cover is located at a closed position.
Figure 2B:
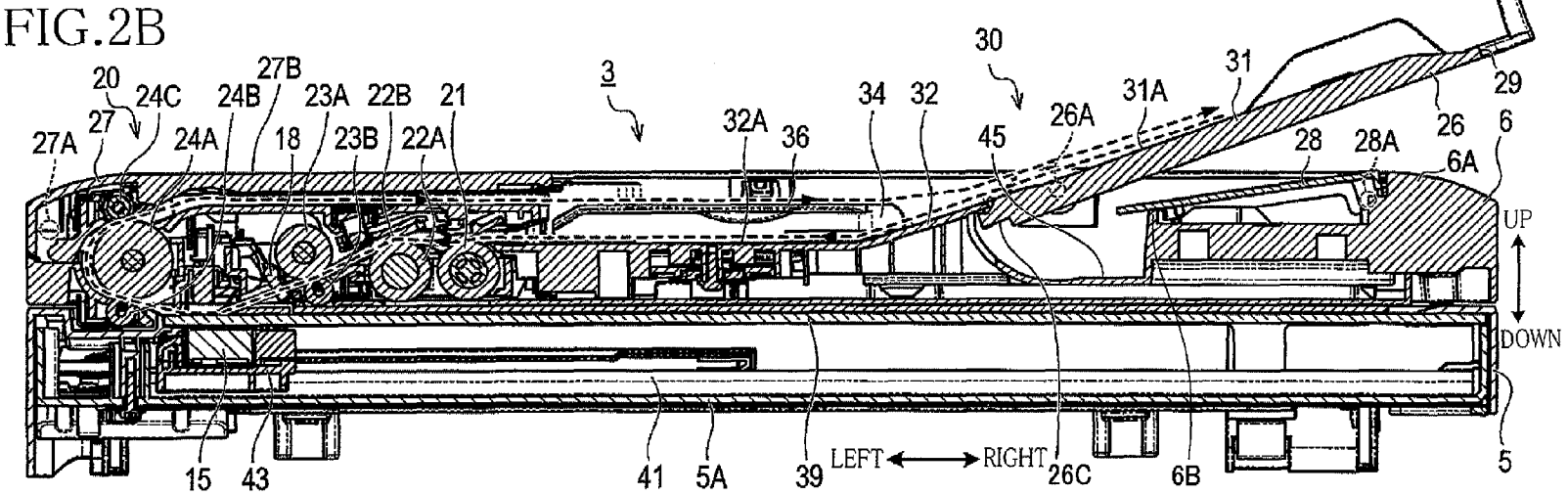
FIG. 2B is an elevational view in vertical cross section illustrating the reading unit whose central cover is located at an open position.

There will be next explained the configuration of the reading unit 3 in more detail. As illustrated in FIGS. 2A and 2B, the ADF unit 6 of the reading unit 3 includes a conveying unit 20 (as one example of a conveyor) configured to convey a sheet along a predetermined conveyance path indicated by the broken line in FIG. 2B. This conveying unit 20 includes a supply roller 21, a separation roller 22A, a separation piece 22B, a relay roller 23A, a relay pinch roller 23B, an inverting roller 24A, a first inverting pinch roller 24B, and a second inverting pinch roller 24C.

As illustrated in FIGS. 2A, 2B, 3A, and 3B, an upper face portion of the ADF unit 6 is provided with a central cover 26 (as one example of a first cover), a left cover 27, and a right cover 28 (as one example of a second cover). The central cover 26 is pivotably supported by a support shaft portion 26A provided near a right end of the central cover 26 in FIG. 2A (noted that a center of the pivotal movement about the support shaft portion 26A is one example of a first axis). This construction allows the central cover 26 to be moved or displaced between a closed position illustrated in FIGS. 2A and 3A and an open position illustrated in FIGS. 2B and 3B. One of a support shaft and a bearing constituting the support shaft portion 26A is provided on the central cover 26, and the other is provided on a housing 6A of the ADF unit 6, for example. When the central cover 26 is located at the closed position, the central cover 26 constitutes a portion of an exterior of an upper surface of the MFP 1, with an exterior surface 26B (as one example of a first exterior surface) facing toward an outside of the MFP 1. An end portion of the central cover 26 near the left cover 27 (on a left side in FIG. 2A) is formed with a handle 29 constituted by a cutout which can be held by the user with his or her fingertips when the user pivots or turns the central cover 26 from the closed position to the open position. When the user moves the central cover 26 from the closed position to the open position, the user holds the handle 29 with his or her fingertips to open or close the central cover 26.

Figure 3A:
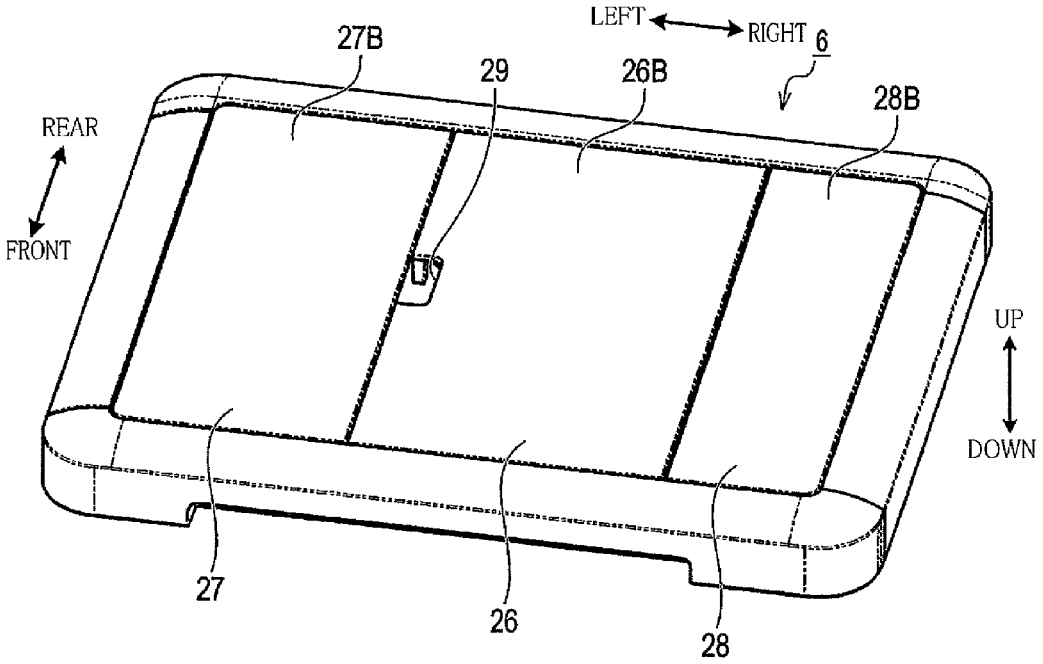
FIG. 3A is a perspective view illustrating an ADF unit in the state in which the central cover is located at the closed position.
Figure 3B:
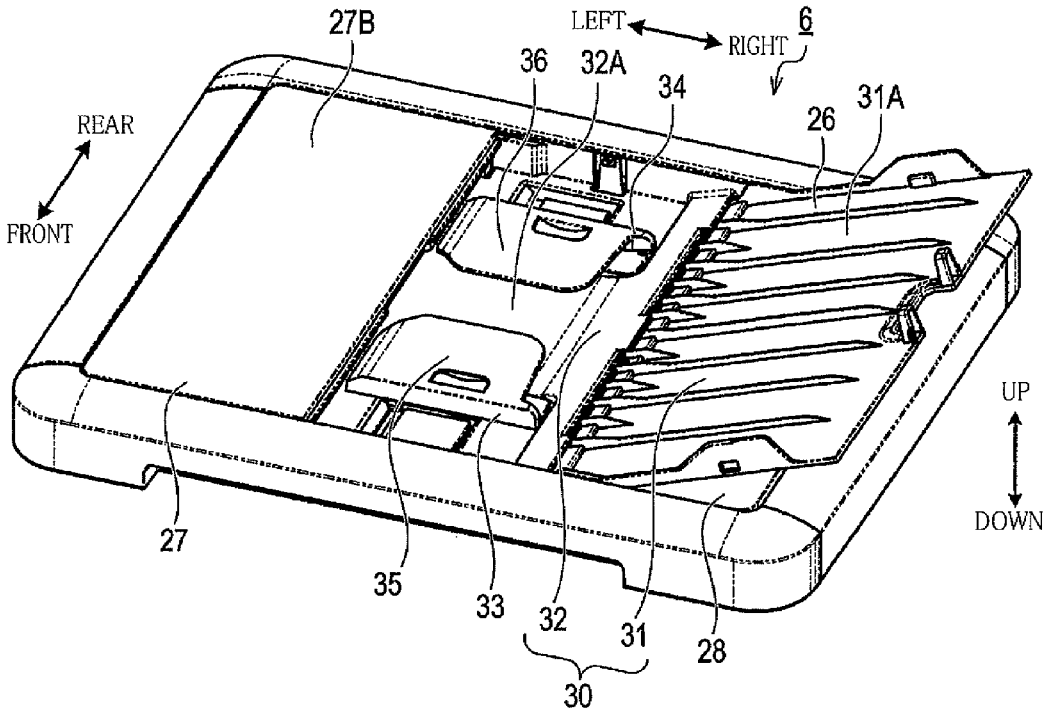
FIG. 3B is a perspective view illustrating the reading unit in the state in which the central cover is located at the open position.

The left cover 27 is disposed adjacent to the central cover 26 on an opposite side of a center of the central cover 26 from the support shaft portion 26A, that is, the left cover 27 is disposed on the left side of the central cover 26 in FIG. 2A. The left cover 27 is pivotably supported by a support shaft portion 27A provided near a left end of the left cover 27 in FIG. 2A. One of a support shaft and a bearing constituting the support shaft portion 27A is provided on the left cover 27, and the other is provided on the housing 6A of the ADF unit 6, for example. FIGS. 2A and 3A illustrate a closed position of the left cover 27. When the left cover 27 is located at the closed position, the left cover 27 constitutes a portion of the exterior of the upper surface of the MFP 1, with an exterior surface 27B facing toward the outside of the MFP 1. Though not shown, when the left cover 27 is pivoted or swung to an open position, the conveying unit 20 is exposed. In case where a sheet is jammed in the conveying unit 20, the user can pivot the left cover 27 to the open position to remove the jammed sheet.

The right cover 28 is pivotably supported by a support shaft portion 28A provided near a right end of the right cover 28 in FIG. 2A (noted that a center of the pivotal movement about the support shaft portion 28A is one example of a second axis). This construction allows the right cover 28 to be moved between a first position illustrated in FIG. 2A and a second position illustrated in FIG. 2B. One of a support shaft and a bearing constituting the support shaft portion 28A is provided on the right cover 28, and the other is provided on the housing 6A of the ADF unit 6, for example. When the right cover 28 is located at the first position, the right cover 28 constitutes a portion of the exterior of the upper surface of the MFP 1, with an exterior surface 28B facing toward the outside of the MFP 1. It is noted that when the right cover 28 is located at the second position, a portion of the housing 6A which is held in contact with the right cover 28 serves as a holder 6B which supports the right cover 28 from a lower side thereof to keep the right cover 28 at the second position.

The central cover 26 has an edge portion 26C (as one example of a recessed portion) at an end portion (as one example of an end portion of the first cover which is adjacent to the second cover) of the central cover 26 which is near the support shaft portion 26A (i.e., a right end portion in FIG. 2A). In the state in which the central cover 26 is located at the closed position (see FIG. 2A), the edge portion 26C is recessed from the exterior surface 26B toward the inside of the MFP 1 so as to form a step between the edge portion 26C and the exterior surface 26B. Also, the edge portion 26C is formed over the entire area of the central cover 26 in its widthwise direction which is perpendicular to the sheet conveying direction. When the central cover 26 is located at the closed position, the right cover 28 is located at the first position, and a left end portion of the right cover 28 in FIG. 2A is superposed on an outer surface of the edge portion 26C. It is noted that this left end portion of the right cover 28 in FIG. 2A is one example of an end portion of the second cover which is adjacent to the first cover and one example of a first end portion. In this state, the end portion of the right cover 28 is inserted in the recessed portion formed in the edge portion 26C, and a lower surface of the end portion of the right cover 28 is held in contact with an outer surface of the edge portion 26C. The thickness of the end portion of the right cover 28 is generally the same in dimension as that of the step formed between the edge portion 26C and the exterior surface 26B. With this construction, the exterior surface 26B of the central cover 26 and the exterior surface 28B of the right cover 28 are flush with each other, so that the two exterior surfaces 26B, 28B constitute a flat surface without a step.

Figure 4:
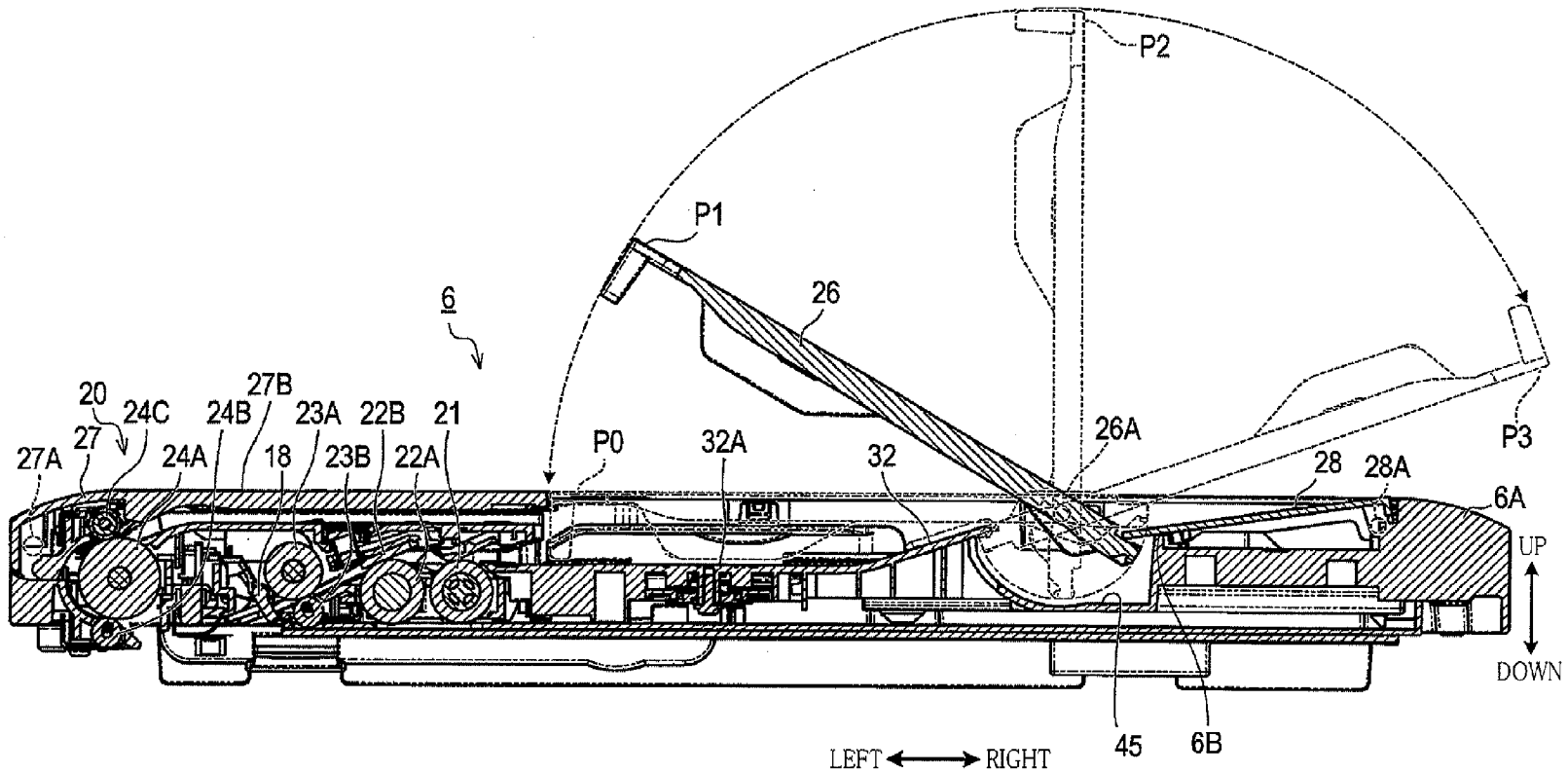
FIG. 4 is a view for explaining a positional relationship between the central cover and a right cover.

The center of gravity of the right cover 28 is located on a left part of the support shaft portion 28A located at its right end in FIG. 2A. Thus, the right cover 28 is always urged by its own weight so as to be pivoted such that a left end portion moves downward. However, the right cover 28 is kept at the first position when the central cover 26 is located at the closed position. When the central cover 26 is operated by the user, as illustrated in FIG. 4, the central cover 26 is moved from a closed position P0 to an open position P3 via an intermediate position P1 and a position P2. When the central cover 26 is moved from the closed position P0 to the intermediate position P1 (as one example of an intermediate position), the right cover 28 is pivoted by its own weight so as to move to the second position (illustrated in FIG. 4) following the central cover 26 while keeping its contact with the central cover 26. When the central cover 26 is thereafter moved from the intermediate position P1 to the open position P3 via the position P2, the lower portion of the right cover 28 is supported by the holder 6B, and accordingly the right cover 28 is kept at the second position, and the central cover 26 is moved off the right cover 28. When the central cover 26 is moved from the open position P3 to the closed position P0, the edge portion 26C of the central cover 26 is brought into contact with the right cover 28 at the intermediate position P1. When the central cover 26 is thereafter moved from the intermediate position P1 to the closed position P0, the central cover 26 is moved to the closed position P0 while keeping its contact with the right cover 28, and the right cover 28 is moved to the first position by a force applied from the central cover 26.

Figure 5A:
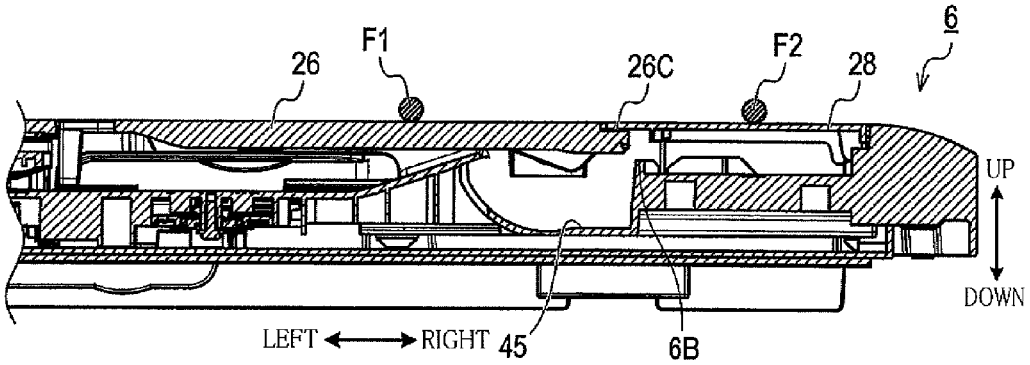
FIG. 5A is a view for explaining a state in which foreign matters are respectively on the central cover and the right cover.
Figure 5B:
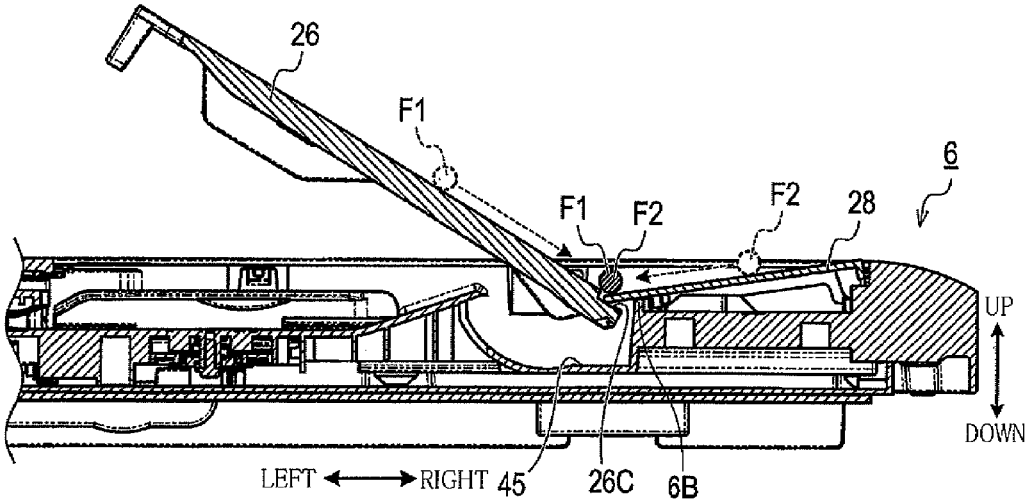
FIG. 5B is a view for explaining a state in which the foreign matters on the central cover and the right cover are slid downward.

Here, it is assumed a case where as illustrated in FIG. 5A a foreign matter F1 and a foreign matter F2 are on the central cover 26 located at the closed position and the right cover 28 located at the first position, respectively. In this case, when the central cover 26 and the right cover 28 are inclined as illustrated in FIG. 5B with a user operation of opening the central cover 26, the foreign matters F1, F2 may slide toward a boundary between the inclined central cover 26 and right cover 28. However, as described above, the central cover 26 is kept in contact with the right cover 28 in a period in which the central cover 26 is moved from the closed position P0 to the intermediate position P1. In this period, accordingly, it is possible to prevent ingress of the foreign matters F1, F2 into the MFP 1. Thus, in the case where the user has become aware of the foreign matters F1, F2 in the period in which the central cover 26 is moved from the closed position P0 to the intermediate position P1, the user may suspend the operation of opening or closing the central cover 26 to easily remove the foreign matters F1, F2.

Figure 5C:
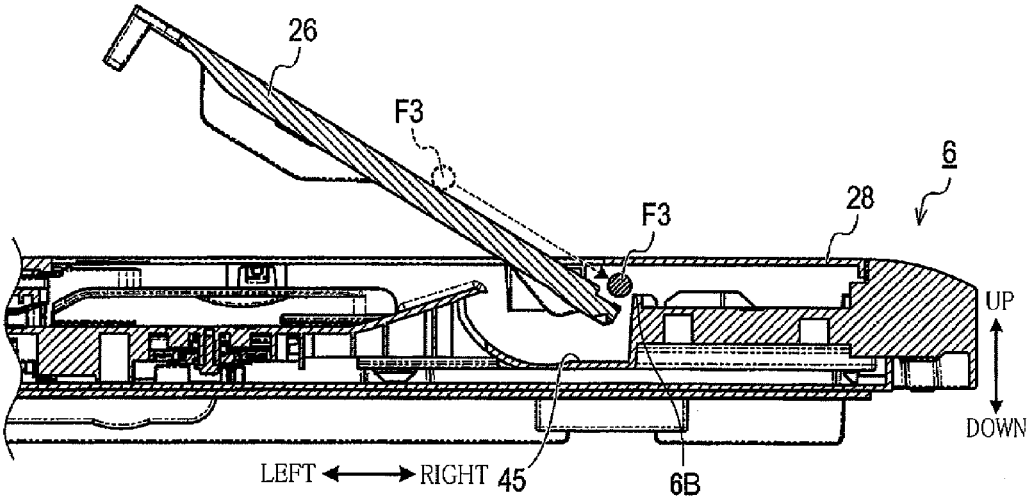
FIG. 5C is a view for explaining a state in which the foreign matter enters into the MFP in the case where the right cover is not moved.

It is noted that in the case where a component equivalent to the right cover 28 is not moved from a position corresponding to the first position, as illustrated in FIG. 5C, a component equivalent to the central cover 26 is moved off the component equivalent to the right cover 28, and accordingly a foreign matter F3 may unfortunately enter into the MFP in an initial stage of the opening or closing operation. That is, even if the user has become aware of the foreign matter F3 immediately after a start of the opening or closing operation, the foreign matter F3 enters into the MFP as soon as the component equivalent to the central cover 26 is moved off the component equivalent to the right cover 28, which may make it impossible for the user to remove the foreign matter F3. However, as described above, in the case where ingress of the foreign matters F1, F2 is prevented until the central cover 26 is moved to the position P1, the user may clear the foreign matters F1, F2 with a considerably higher possibility.

Figure 6:
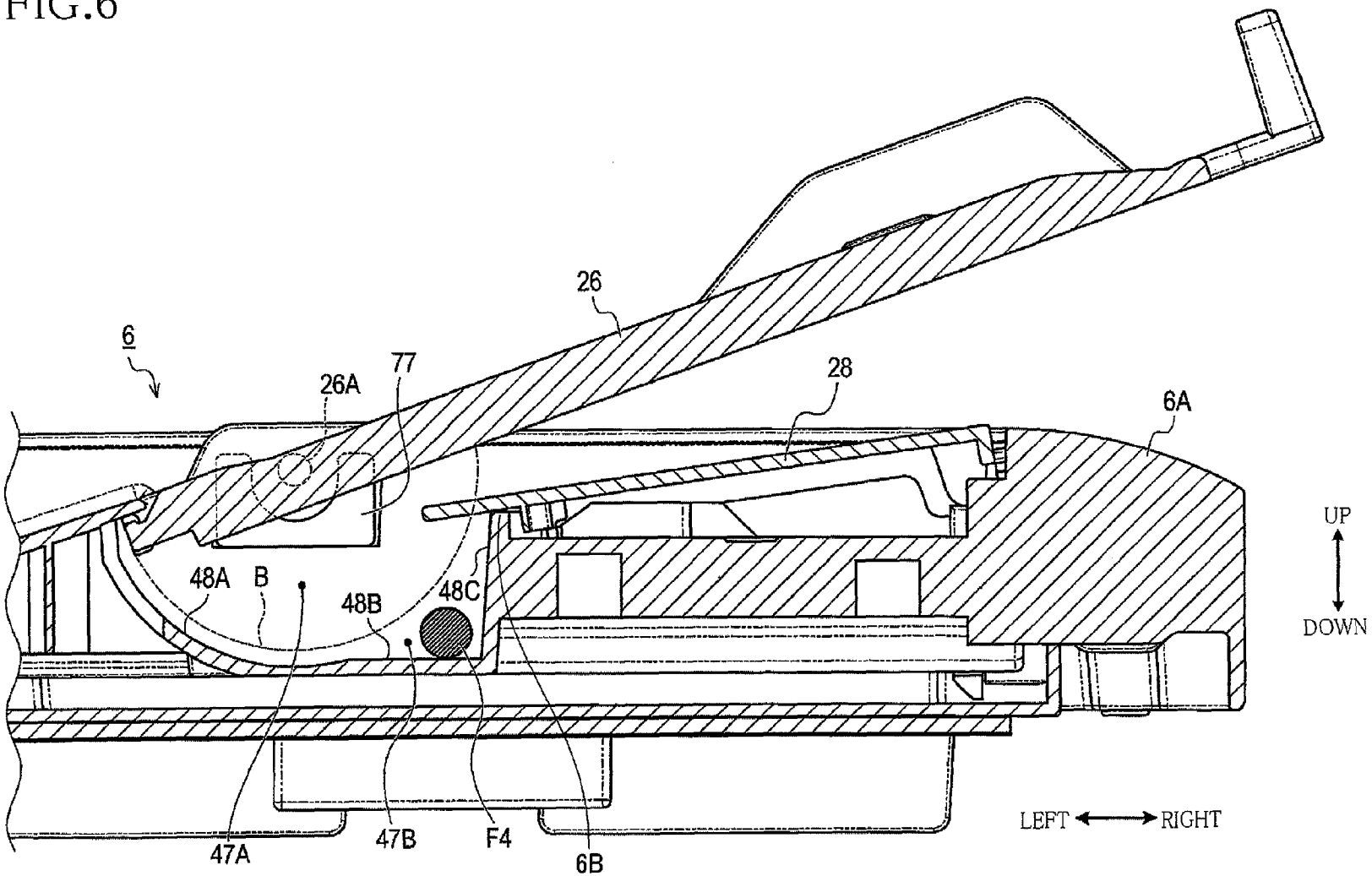
FIG. 6 is a view for explaining a state in which a receiver keeps a foreign matter.

In the period in which the central cover 26 is being moved from the position P1 to the open position P3, the central cover 26 is spaced apart from the right cover 28. In this period, accordingly, there is a possibility of ingress of foreign matters into the MFP from a position between the central cover 26 and the right cover 28. However, a recessed receiver 45 is provided under the end portion of the right cover 28 which is opposite side of the center of the right cover 28 from the support shaft portion 28A (i.e., the left end portion in FIG. 5A). Accordingly, even if a foreign matter F4 has entered into the MFP from the position between the central cover 26 and the right cover 28, as illustrated in FIG. 6, the foreign matter F4 is received in the receiver 45.

A space formed on an inner side of the receiver 45 includes: a first area 47A into which the end portion of the central cover 26 near the support shaft portion 26A can enter when the central cover 26 is pivoted between the closed position and the open position; and a second area 47B located outside the first area 47A. When the central cover 26 is pivoted between the closed position and the open position, the end portion of the central cover 26 draws a path which is an imaginary boundary surface B indicated by the one-dot chain line in FIG. 6. The first area 47A is located on a side of the boundary surface B nearer to the support shaft portion 26A. The second area 47B is located on an opposite side of the boundary surface B from the first area 47A and nearer to the right cover 28 than the first area 47A. In the present embodiment, the housing 6A of the ADF unit 6 has a curved surface 48A formed along the path drawn by the end portion of the central cover 26, and this curved surface 48A partly defines the first area 47A. The housing 6A of the ADF unit 6 also has a generally horizontal inner bottom surface 48B and an inner wall surface 48C generally perpendicular to the inner bottom surface 48B. These inner bottom surface 48B and inner wall surface 48C partly define the second area 47B.

Even if the foreign matter F4 has entered into the MFP 1, the receiver 45 may keep the foreign matter F4 therein, preventing ingress of the foreign matter F4 into other areas. Also, when the end portion of the central cover 26 is moved in the first area 47A, the foreign matter F4 pushed out of the first area 47A may be moved into the second area 47B described above. Accordingly, it is possible to prevent the foreign matter F4 from interfering with the movement of the central cover 26 and prevent the foreign matter F4 from being caught between the central cover 26 and the housing 6A of the ADF unit 6. Also, since the inner bottom surface 48B of the second area 47B is flat, the foreign matter F4 moved to the second area 47B is not easily moved into the first area 47A.

When the central cover 26 is located at the open position, the central cover 26 constitutes a portion of a supporter 30 configured to support a sheet to be supplied to the conveying unit 20 and a sheet to be discharged from the conveying unit 20. More specifically, when located at the open position, the central cover 26 serves as a first support member 31 for supporting a sheet on a first support surface 31A which is a back side of the first support member 31 from the exterior surface 26B (noted that the central cover 26 may be hereinafter referred to as "the first support member 31" as needed). In the state in which the central cover 26 is located at the closed position, a second support member 32 having a second support surface 32A is disposed under the central cover 26. In the state in which the central cover 26 is located at the open position, the first support member 31 and the second support member 32 constitute the above-described supporter 30.

Side guides 33, 34 are provided on the second support member 32. The side guides 33, 34 can respectively contact opposite edges of the sheet supported on the second support surface 32A, in the widthwise direction perpendicular to the sheet conveying direction. The side guides 33, 34 are slid in the widthwise direction of the sheet (i.e., the front and rear direction in FIG. 3B) to change a distance therebetween. More specifically, when one of the side guides 33, 34 is slid in one direction, the other guide is slid in conjunction with the sliding movement of the one guide in a direction opposite the direction in which the one guide is slid. With this construction, when changing the distance between the pair of side guides 33, 34, the user only needs to operate one of the side guides 33, 34 to slide the side guides 33, 34 such that the side guides 33, 34 move toward or away from each other.

The side guides 33, 34 are respectively provided with extending portions 35, 36 extending generally horizontally toward each other from upper edges of the respective side guides 33, 34. A sheet or sheets to be conveyed are placed under these extending portions 35, 36. The side guides 33, 34 are respectively brought into contact with opposite edges of the placed sheets in its widthwise direction to correct a sheet conveying direction of the sheet. This operation may reduce a possibility of occurrence of skew of the sheet conveyed by the conveying unit 20. The sheet placed under the extending portions 35, 36 is conveyed along the conveyance path indicated by the broken line in FIG. 2B. Sheets supplied by the supply roller 21 from the second support member 32 toward a downstream side thereof in the sheet conveying direction are separated one by one by the separation roller 22A and the separation piece 22B. The separated sheet is conveyed by the relay roller 23A toward a downstream side thereof in the sheet conveying direction. The sheet conveyed by the relay roller 23A is brought into contact with the sheet detecting sensor 18, so that a leading edge and/or a trailing edge of the sheet is detected. The sheet having passed through the sheet detecting sensor 18 is further conveyed by the inverting roller 24A toward a downstream side thereof in the sheet conveying direction. As a result, the sheet is conveyed over upper surfaces of the respective extending portions 35, 36 and discharged onto the supporter 30 constituted by the second support member 32 and the first support member 31.

The FB unit 5 includes a platen 39, a guide rail 41, and a carriage 43. The platen 39 is a transparent glass plate which constitutes a support surface as an upper surface of the FB unit 5 which supports an object to be read. The guide rail 41 is integrally formed in an inner surface of a bottom portion of a housing 5A of the FB unit 5. The guide rail 41 extends in the right and left direction in FIG. 2B in a state in which the guide rail 41 is parallel with a lower surface of the platen 39. The carriage 43 is mounted on an upper surface of the guide rail 41. In this state, the carriage 43 is supported so as to be reciprocable along the guide rail 41 in the right and left direction. This carriage 43 is coupled to an endless toothed belt, not shown. When the toothed belt is driven and rotated by the motor 16 (see FIG. 1), the carriage 43 is reciprocated in the right and left direction following the toothed belt.

The image sensor 15 is mounted on the carriage 43 in a state in which the main scanning direction coincides with the front and rear direction in FIG. 2A (i.e., a direction perpendicular to each of the right and left direction and the up and down direction in FIG. 2A), and the reading elements face upward. With this construction, when the carriage 43 is reciprocated in the right and left direction, the image sensor 15 is moved with the carriage 43 in the sub-scanning direction. In the case where the image sensor 15 reads an image on a sheet placed on the upper surface of the platen 39, the image sensor 15 reads the image while moving together with the carriage 43. In the case where the image sensor 15 reads an image of a sheet conveyed by the conveying unit 20, the sheet passes through the upper surface of the platen 39 while contacting the upper surface, at a position located between the relay roller 23A and the inverting roller 24A. The movement of the image sensor 15 is stopped under this contact position, and the image sensor 15 reads the image on the sheet through the platen 39.

Positioning Mechanism for Positioning Central Cover

Figure 7:
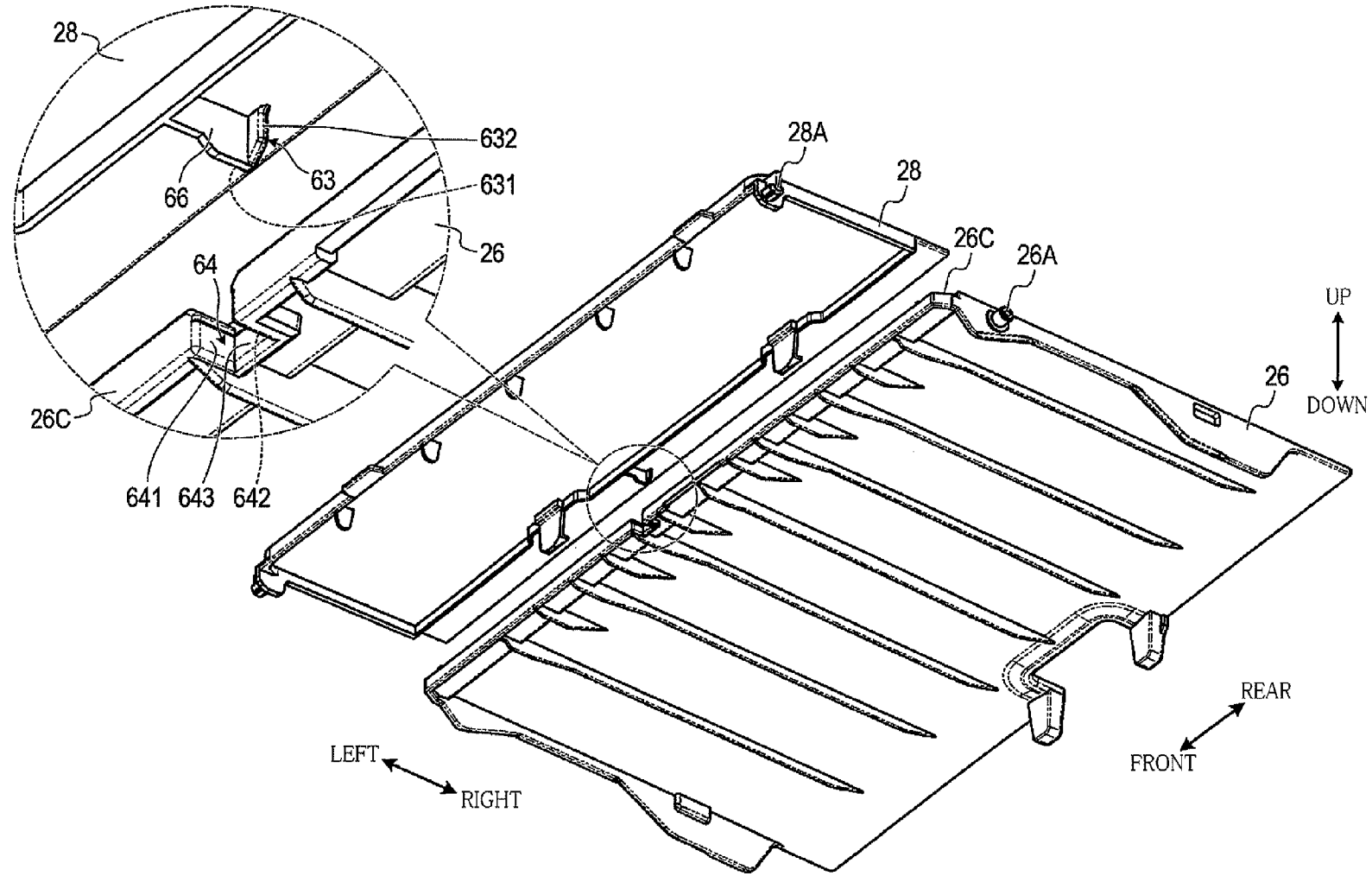
FIG. 7 is a perspective view illustrating a positioning mechanism for positioning the central cover and the right cover.
Figure 8A:
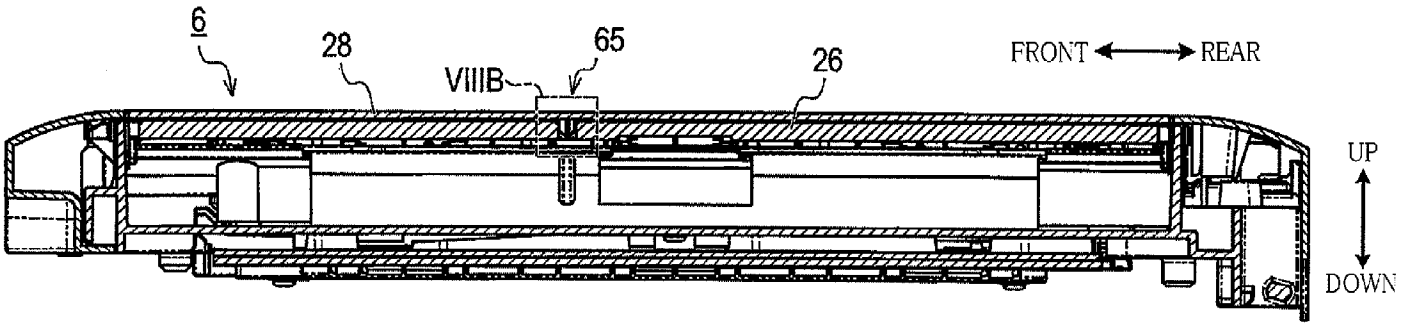
FIG. 8A is a cross-sectional view of the ADF unit taken along line VIIIA-VIIIA in FIG. 2A.
Figure 8B:
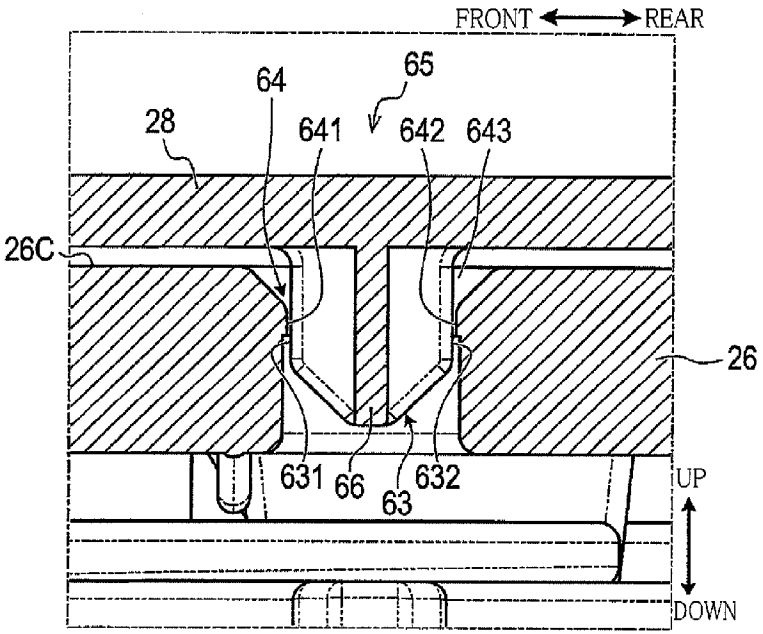
FIG. 8B is an enlarged view of an area VIIIB in FIG. 8A.

There will be next explained a positioning mechanism for positioning the central cover 26. As illustrated in FIG. 7, a first protruding portion 63 (as one example of a contacting portion) is provided on the right cover 28 at an area which overlaps an outer surface of the edge portion 26C of the central cover 26. The first protruding portion 63 protrudes from the right cover 28 toward the inside of the MFP 1 (i.e., downward in FIG. 7). The edge portion 26C of the central cover 26 has inner wall surfaces 641, 642 (as one example of a contacted portion) for defining a cutout 64 which is a recess formed in the edge portion 26C at a face portion thereof near the right cover 28 (i.e., the face portion of the left edge portion in FIG. 7). As illustrated in FIGS. 8A and 8B, the first protruding portion 63 and the inner wall surfaces 641, 642 constitute a first positioning mechanism 65 which positions the central cover 26 and the right cover 28 in the front and rear direction by the first protruding portion 63 moved into the cutout 64 and brought into contact with the inner wall surface 641 or the inner wall surface 642 when the central cover 26 is moved to the closed position.

More specifically, the first protruding portion 63 is a plate member whose thickness direction coincides with the direction perpendicular to the sheet surface of FIG. 8B (i.e., the right and left direction), and the first protruding portion 63 has contact areas 631, 632 on its opposite sides in the front and rear direction in FIGS. 7, 8A, and 8B. In FIG. 7, however, the contact area 631 is hidden behind a rib 66 and cannot be viewed. The rib 66 is integrally formed on the right cover 28 with the first protruding portion 63. This rib 66 improves the stiffness of the first protruding portion 63.

The cutout 64 is defined by (i) the inner wall surface 641 located in front of the cutout 64 in FIGS. 7, 8A, and 8B, (ii) the inner wall surface 642 located at the rear of the cutout 64 in FIGS. 7, 8A, and 8B, and (iii) an inner wall surface 643 located on the left side of the cutout 64 in FIG. 7. In FIG. 7, however, the inner wall surface 642 is hidden and cannot be viewed. In the case where the first protruding portion 63 is fitted in the cutout 64, as illustrated in FIG. 8B, the contact area 631 is opposed to the inner wall surface 641, and the contact area 632 is opposed to the inner wall surface 642.

With this construction, the first protruding portion 63 and the cutout 64 are prevented from being moved relatively from each other in the front and rear direction. As a result, the relative positions of the central cover 26 and the right cover 28 are determined in the front and rear direction. The end portion of the right cover 28 overlaps the outer surface of the edge portion 26C of the central cover 26, thereby determining the relative positions of the central cover 26 and the right cover 28 also in the up and down direction. As a result, as described above, the two exterior surfaces 26B, 28B become a flat surface without any step.

Figure 9:
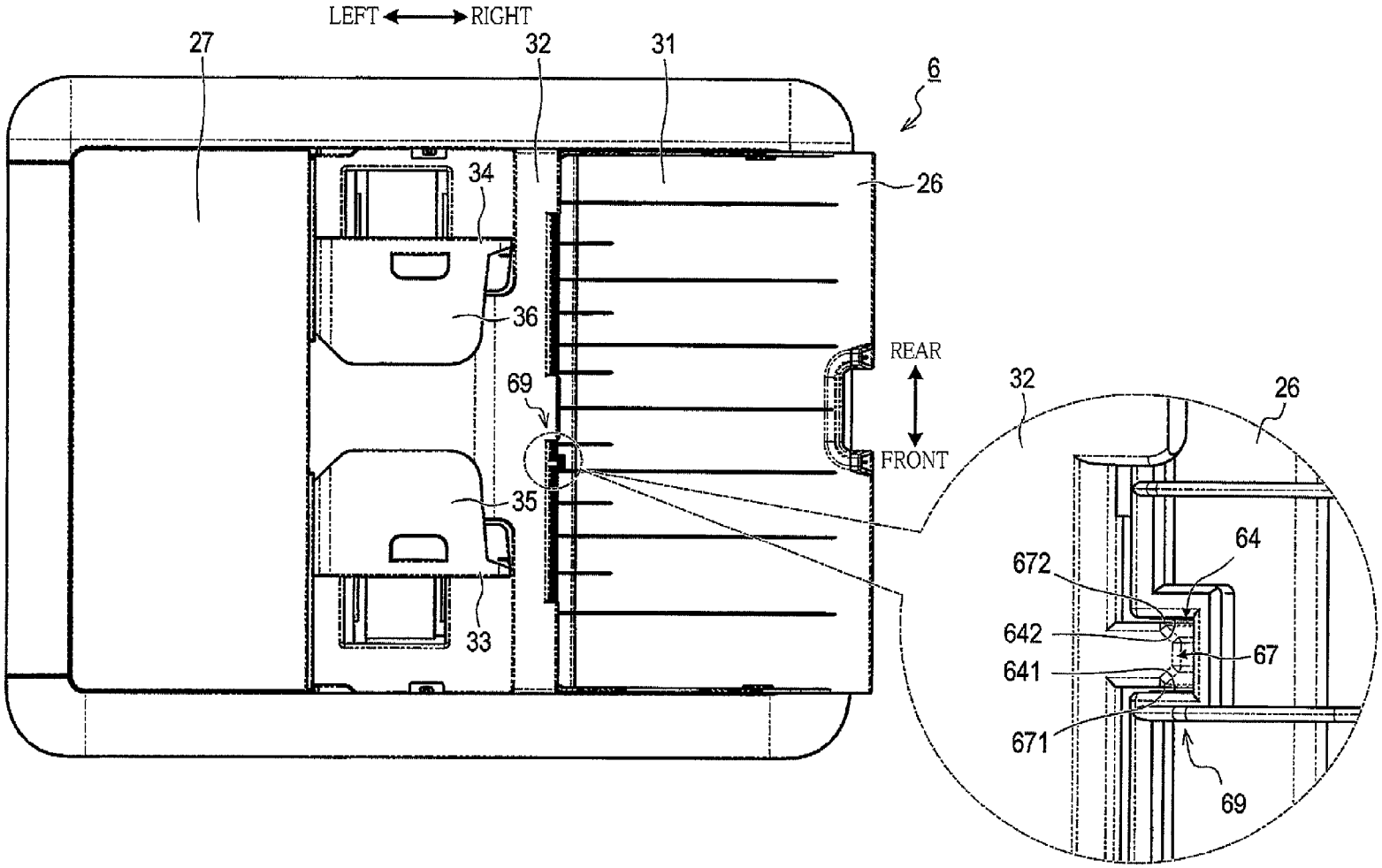
FIG. 9 is a plan view illustrating a positioning mechanism for positioning the central cover and a second support member.

The cutout 64 is used for positioning the central cover 26 also when the central cover 26 is moved to the open position. Specifically, as illustrated in FIG. 9, the second support member 32 is provided with a second protruding portion 67. The second protruding portion 67 and the cutout 64 constitute a second positioning mechanism 69 which positions the central cover 26 and the second support member 32 in the front and rear direction by the second protruding portion 67 moved into the cutout 64 when the central cover 26 is moved to the closed position.

The second protruding portion 67 protrudes from a right edge of the second support member 32 toward the central cover 26 located at the open position. The second protruding portion 67 has contact areas 671, 672 on its opposite sides in the front and rear direction in FIG. 9. In the case where the first protruding portion 63 is fitted in the cutout 64, as illustrated in FIG. 9, the contact area 671 is opposed to the inner wall surface 641, and the contact area 672 is opposed to the inner wall surface 642. With this construction, the second protruding portion 67 and the cutout 64 are prevented from being moved relatively from each other in the front and rear direction. As a result, the relative positions of the central cover 26 and the second support member 32 are determined in the front and rear direction.

When the central cover 26 is positioned in the front and rear direction by the above-described construction (i.e., the first positioning mechanism 65 and the second positioning mechanism 69), the central cover 26 is positioned as designed in the front and rear direction even in the case where the central cover 26 is located any of the closed position and the open position. This construction may eliminate variations of an external appearance of the ADF unit 6 due to individual differences, resulting in improvement of the external appearance.

Wobbling Reduction Mechanism for Central Cover

Figure 10A:
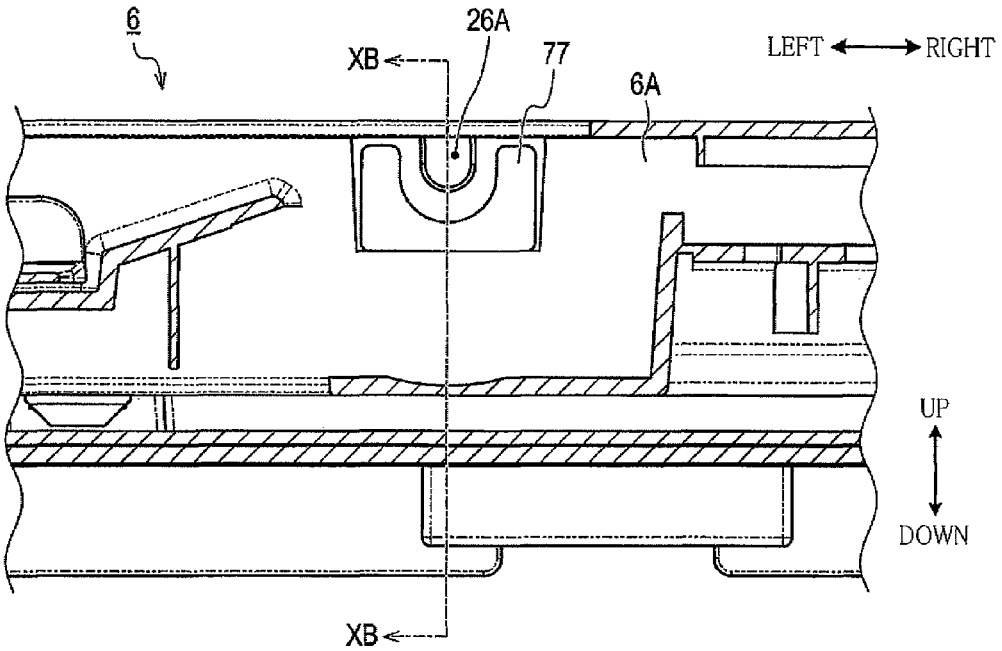
FIG. 10A is an elevational view in vertical cross section illustrating a construction near a cushion.
Figure 10B:
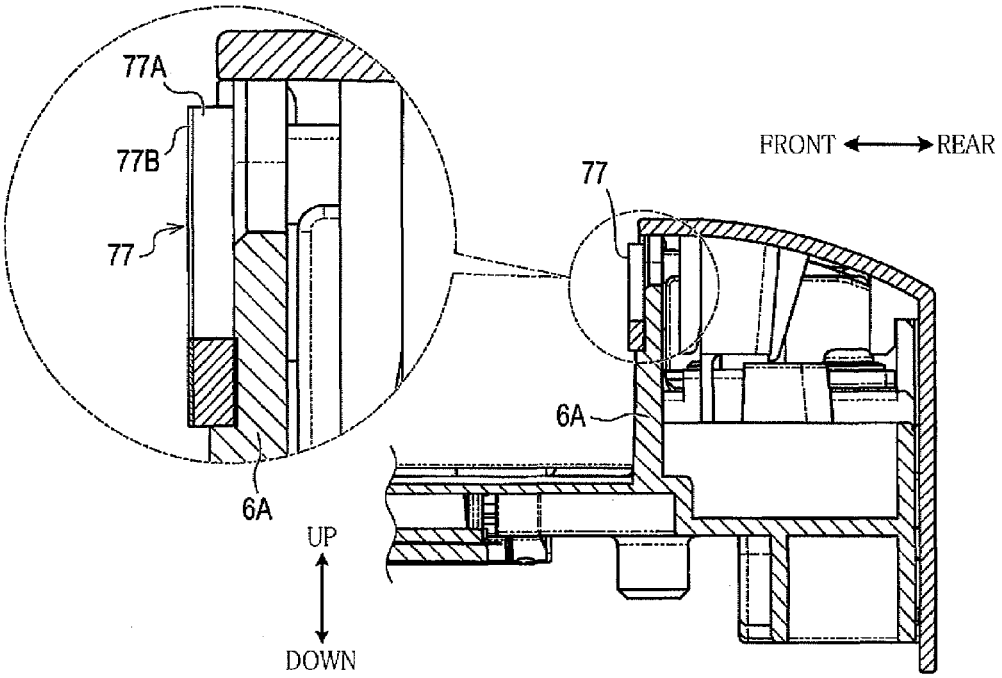
FIG. 10B is a cross-sectional view of the construction near the cushion, taken along line XB-XB in FIG. 10A.

As illustrated in FIGS. 10A and 10B, a cushion 77 is provided near the support shaft portion 26A of the central cover 26 at a position between the central cover 26 and the housing 6A of the ADF unit 6. This cushion 77 includes a sponge 77A formed of resin foam and a film 77B laminated on a surface of the sponge 77A. The cushion 77 is bonded at the sponge 77A to the housing 6A. The central cover 26 is slidably contacts the cushion 77 at the film 77B.

The cushion 77 is compressed when a space formed between the central cover 26 and the housing 6A of the ADF unit 6 becomes smaller. On the other hand, the compressed shape of the cushion 77 is returned to its original shape when the amount of the space is increased and returned. This construction reduces wobbling of the central cover 26 when the central cover 26 is moved between the open position and the closed position. The film 77B is constituted by a plastic film (e.g., PET film) having a sliding resistance smaller than that of the surface of the sponge 77A, allowing smooth pivotal movement of the central cover 26 when compared with the case where the sponge 77A is provided alone.

The cushion 77 is always located between the central cover 26 and the housing 6A even when the central cover 26 is moved to any position between the closed position and the open position. That is, considering an area where the central cover 26 is pivoted, the shape, size, and arrangement of the cushion 77 are designed such that the cushion 77 is located between the central cover 26 and the housing 6A even when the central cover 26 is moved within the area of its pivotal movement. In other words, when viewed in a direction parallel to the center of the pivotal movement of the central cover 26, the cushion 77 and the central cover 26 have a positional relationship in which the cushion 77 and the central cover 26 always overlap each other even when the central cover 26 is moved to any position between the closed position and the open position. When the central cover 26 is pivoted, an edge of the central cover 26 which contacts the cushion 77 is moved while keeping a positional relationship in which the edge of the central cover 26 intersects an edge of the cushion 77 and a positional relationship in which the edge of the central cover 26 is held in contact with the cushion 77. This construction prevents the edge of the central cover 26 from being caught by the edge of the cushion 77.

Effects

In the MFP 1 as described above, while the right cover 28 is being moved from the first position to the second position, the respective end portions of the central cover 26 and the right cover 28 are kept overlapping each other in the up and down direction. Accordingly, the space formed between the central cover 26 and the right cover 28 is considerably small when compared with the case where the right cover 28 is not moved from the position corresponding to the first position. This construction may reduce a possibility of ingress of a foreign matter from the space into the MFP 1. Also, after the right cover 28 reaches the second position, the central cover 26 is moved off the right cover 28 and pivoted toward the open position. Accordingly, a corresponding space is formed between the central cover 26 and the right cover 28 in this period, but the space is not considerably large when compared with the case where the right cover 28 is not moved from the position corresponding to the first position. This construction may reduce a possibility of ingress of a foreign matter from the space into the MFP 1.

Even in the case where a foreign matter falls from a space formed between the central cover 26 and the right cover 28 in a stage in which the space is formed, the foreign matter may be received by the receiver 45. Accordingly, the foreign matter may be kept in the receiver 45, preventing occurrence of a trouble in which the foreign matter adversely affects the components disposed outside the receiver 45.

MODIFICATIONS

While the embodiment has been described above, it is to be understood that the disclosure is not limited to the details of the illustrated embodiment, but may be embodied with various changes and modifications, which may occur to those skilled in the art, without departing from the spirit and scope of the disclosure.

For example, while the positioning mechanism for positioning the central cover 26 and the right cover 28 in the front and rear direction is used in the above-described embodiment, this positioning mechanism may not be used. It is noted that even in the case where the MFP has no construction for reducing a possibility of ingress of a foreign matter into the MFP, effects may be obtained by using the positioning mechanism. Accordingly, the positioning mechanism as described above may be used regardless of whether the right cover 28 is moved to the second position or not.

While the wobbling reduction mechanism using the cushion 77 is used in the above-described embodiment, such a wobbling reduction mechanism may not be used. It is noted that even in the case where the MFP has no construction for reducing a possibility of ingress of a foreign matter into the MFP, effects may be obtained by using the wobbling reduction mechanism. Accordingly, the wobbling reduction mechanism as described above may be used regardless of whether the right cover 28 is moved to the second position or not.

The wobbling reduction mechanism using the cushion 77 is provided near the support shaft portion 26A of the central cover 26 in the above-described embodiment. However, in the case where the MFP includes a component pivotably supported by a similar support shaft portion, a similar wobbling reduction mechanism may be provided near such a support shaft portion. For example, a component equivalent to the cushion 77 may be provided near the support shaft portion 27A for supporting the left cover 27 pivotably or the support shaft portion 28A for supporting the right cover 28 pivotably. A component equivalent to the cushion 77 may be provided not only near the support shaft portion for each of the central cover 26, the left cover 27, and the right cover 28 but also near a support shaft portion for a component pivotably supported at a shaft.

While the cushion 77 is bonded to the housing 6A, and the central cover 26 slidably contacts the cushion 77 in the above-described embodiment, a cushion may be bonded to the central cover 26. In this construction, the cushion which is moved with the central cover 26 slidably contacts the housing 6A. The cushion is also compressed when the space formed between the central cover 26 and the housing 6A becomes smaller. On the other hand, the compressed shape of the cushion is returned to its original shape when the amount of the space is increased and returned. This construction reduces wobbling of the central cover 26 when the central cover 26 is moved between the open position and the closed position.

It is noted that the ADF unit 6 of the MFP 1 is used as one example of the sheet conveying device in the above-described embodiment, but the sheet conveying device may not be provided in the MFP. For example, the above-described construction may be used for an image reading device having only an image reading function, a copying machine, and a facsimile machine.

What is claimed is:

1. A sheet conveying device, comprising:

a conveyor configured to convey a sheet along a conveyance path; and a supporter configured to support one of a sheet to be supplied to the conveyor and a sheet to be discharged from the conveyor, the supporter comprising:

a first cover pivotable between a closed position and an open position about a first axis, the first cover constituting a portion of an exterior of the sheet conveying device in a state in which a first exterior surface of the first cover faces toward an outside of the sheet conveying device when the first cover is located at the closed position, the first cover supporting the sheet when the first cover is located at the open position; and a second cover pivotable between a first position and a second position about a second axis extending parallel with the first axis, the second cover constituting a portion of the exterior of the sheet conveying device with the first cover when the second cover is located at the first position, the second cover comprising a substantially flat upper surface, the first cover comprising an end portion adjacent to the second cover in a state in which the first cover is located at the closed position, the end portion being formed with a recessed portion recessed from the first exterior surface toward an inside of the sheet conveying device in the state in which the first cover is located at the closed position, the second cover comprising an end portion adjacent to the first cover in a state in which the second cover is located at the first position, the end portion of the second cover being provided with a first end portion, at least a portion of which is to be inserted into the recessed portion of the first cover located at the closed position and is contactable with the first cover, the first end portion being kept in contact with the first cover throughout a period in which the second cover is pivoted from the first position to the second position, the sheet conveying device further comprising a holder configured to hold the second cover located at the second position when the second cover has been pivoted from the first position to the second position, the second cover comprising a first end and a second end that is nearer to the second axis than the first end, the holder being configured to hold the second cover located at the second position in a state in which the first end of the second cover is spaced apart from a bottom surface located under the first cover, the sheet conveying device further comprising a standing wall extending from the bottom surface toward the second cover, the standing wall comprising a distal end serving as the holder, the standing wall being located between the first end of the second cover and the second axis.

2. The sheet conveying device according to claim 1, wherein the first end portion is kept in contact with the first cover throughout a period in which the first cover is pivoted from the closed position to an intermediate position located between the closed position and the open position.

3. The sheet conveying device according to claim 2, wherein the first end portion is spaced apart from the first cover throughout a period in which the first cover is pivoted from the intermediate position to the open position.

4. The sheet conveying device according to claim 1, wherein the second cover is supported by a shaft such that the second cover is pivoted by a weight of the second cover itself in a direction directed from the first position toward the second position.

5. The sheet conveying device according to claim 1, further comprising a receiver defining a recess formed under the end portion of the second cover, which end portion is adjacent to the first cover.

6. The sheet conveying device according to claim 5, wherein a first area and a second area are formed on an inner side of the receiver, and wherein the first area includes an area through which the first cover passes when the first cover is pivoted between the closed position and the open position, and the second area is an area located between the first area and the receiver.

7. The sheet conveying device according to claim 6, wherein a path drawn by the end portion of the first cover when the first cover is pivoted between the closed position and the open position is an imaginary boundary surface, wherein the first area includes a space located nearer to the first axis than the imaginary boundary surface, and wherein the second area is a space located on an opposite side of the imaginary boundary surface from the first area and nearer to the second cover than the first area.

8. The sheet conveying device according to claim 7, wherein the receiver comprises: a curved surface extending along the path drawn by the end portion of the first cover; an inner bottom; and an inner wall, and wherein the first area is at least partly defined by the curved surface.

9. The sheet conveying device according to claim 8, wherein the inner bottom extends substantially horizontally, and the inner wall is substantially perpendicular to the inner bottom, and wherein the second area is at least partly defined by the inner bottom and the inner wall.

10. The sheet conveying device according to claim 1, further comprising a positioning mechanism comprising: a contacting portion provided with one of the first cover and the second cover; and a contacted portion provided with another of the first cover and the second cover, wherein when the first cover is located at the closed position, the contacting portion contacts the contacted portion such that the first cover and the second cover are positioned relative to each other in a direction parallel with the first axis.

11. A sheet conveying device, comprising:

a conveyor configured to convey a sheet along a conveyance path; and a supporter configured to support one of a sheet to be supplied to the conveyor and a sheet to be discharged from the conveyor, the supporter comprising:

a first cover pivotable between a closed position and an open position about a first axis, the first cover constituting a portion of an exterior of the sheet conveying device in a state in which a first exterior surface of the first cover faces toward an outside of the sheet conveying device when the first cover is located at the closed position, the first cover supporting the sheet when the first cover is located at the open position; and a second cover pivotable between a first position and a second position about a second axis extending parallel with the first axis, the second cover constituting a portion of the exterior of the sheet conveying device with the first cover when the second cover is located at the first position, the first cover comprising an end portion adjacent to the second cover in a state in which the first cover is located at the closed position, the end portion being formed with a recessed portion recessed from the first exterior surface toward an inside of the sheet conveying device in the state in which the first cover is located at the closed position, the second cover comprising an end portion adjacent to the first cover in a state in which the second cover is located at the first position, the end portion of the second cover being provided with a first end portion, at least a portion of which is to be inserted into the recessed portion of the first cover located at the closed position and is contactable with the first cover, the first end portion being kept in contact with the first cover throughout a period in which the second cover is pivoted from the first position to the second position, wherein the sheet conveying device further comprises a positioning mechanism comprising: a contacting portion provided with one of the first cover and the second cover; and a contacted portion provided with another of the first cover and the second cover, wherein when the first cover is located at the closed position, the contacting portion contacts the contacted portion such that the first cover and the second cover are positioned relative to each other in a direction parallel with the first axis, wherein the contacting portion is a first protruding portion provided on the second cover, wherein the contacted portion is an inner wall surface defining one of a cutout and a hole formed in the first cover, and wherein when the first cover and the second cover are respectively located at the closed position and the first position, the first protruding portion is inserted in the one of the cutout and the hole and held in contact with the inner wall surface such that the first cover and the second cover are positioned relative to each other in the direction parallel with the first axis.

12. The sheet conveying device according to claim 11, wherein the first cover serves as a first support member configured to support the sheet when the first cover is located at the open position, wherein the sheet conveying device comprises:

a second support member which is covered with the first cover when the first cover is located at the closed position and which is exposed to support the sheet with the first cover when the first cover is located at the open position; and a second protruding portion provided on the second support member, and wherein when the first cover is located at the open position, the second protruding portion is inserted in the one of the cutout and the hole such that the first cover and the second support member are positioned relative to each other in the direction parallel with the first axis.

13. A sheet conveying device, comprising:

a conveyor configured to convey a sheet along a conveyance path; and a supporter configured to support one of a sheet to be supplied to the conveyor and a sheet to be discharged from the conveyor, the supporter comprising:

a first cover pivotable between a closed position and an open position about a first axis, the first cover constituting a portion of an exterior of the sheet conveying device in a state in which a first exterior surface of the first cover faces toward an outside of the sheet conveying device when the first cover is located at the closed position, the first cover supporting the sheet when the first cover is located at the open position; and a second cover pivotable between a first position and a second position about a second axis extending parallel with the first axis, the second cover constituting a portion of the exterior of the sheet conveying device with the first cover when the second cover is located at the first position, the first cover comprising an end portion adjacent to the second cover in a state in which the first cover is located at the closed position, the end portion being formed with a recessed portion recessed from the first exterior surface toward an inside of the sheet conveying device in the state in which the first cover is located at the closed position, the second cover comprising an end portion adjacent to the first cover in a state in which the second cover is located at the first position, the end portion of the second cover being provided with a first end portion, at least a portion of which is to be inserted into the recessed portion of the first cover located at the closed position and is contactable with the first cover, the first end portion being kept in contact with the first cover throughout a period in which the second cover is pivoted from the first position to the second position, wherein a pivot shaft is provided on one of the first cover and a main body configured to support the first cover, wherein a bearing configured to support the pivot shaft pivotably is provided on another of the first cover and the main body, and wherein a cushion is provided on a first member which is one of the first cover and the main body, and the cushion is configured to limit movement of the first cover with respect to the main body in a direction parallel with the first axis.

14. The sheet conveying device according to claim 13, wherein a second member which is another of the first cover and the main body is slidably pivoted relative to the cushion, and wherein a film is provided on a surface of the cushion on which the second member is slid.

15. The sheet conveying device according to claim 13, wherein the cushion is provided on the main body, and the first cover is slid with respect to the cushion.

16. The sheet conveying device according to claim 1, wherein the recessed portion is formed on an entire area of the first cover in a widthwise direction perpendicular to a direction in which the sheet is conveyed.

* * * * *